US005255606A

United States Patent [19]

Iijima et al.

[11] Patent Number: 5,255,606

[45] Date of Patent: Oct. 26, 1993

[54] DRAG ROLLER DEVICE FOR PRINTING APPARATUS

[75] Inventors: Takashi Iijima, Yokosuka; Mitsuo Kitai, Yokohama; Hideo Ohta, Tokyo, all of Japan

[73] Assignee: Kabushikigaisha Tokyo Kikai Seisakusho, Tokyo, Japan

[21] Appl. No.: 679,207

[22] Filed: Apr. 2, 1991

[30] Foreign Application Priority Data

Apr. 2, 1990 [JP] Japan ..... 2-87702

[51] Int. Cl.[5] ..... B41F 35/00; B41L 41/00

[52] U.S. Cl. ..... 101/425; 101/423

[58] Field of Search ..... 101/423, 424, 425, DIG. 37; 15/256.5, 256.51, 256.52; 355/301, 302

[56] References Cited

U.S. PATENT DOCUMENTS

| | | | |
|---|---|---|---|
| 3,735,702 | 5/1973 | Kossak | 101/425 |
| 4,015,307 | 4/1977 | Kossak | 101/425 |
| 4,393,778 | 7/1983 | Kaneko | 101/425 |
| 4,651,644 | 3/1987 | Kaempfe et al. | 101/425 |
| 4,747,348 | 5/1988 | Jeschke et al. | 101/425 |
| 4,893,562 | 1/1990 | Robertson | 101/425 |
| 4,905,593 | 3/1990 | Gollinger et al. | 101/425 |
| 4,919,756 | 4/1990 | Sawdai | 101/425 |
| 4,972,780 | 11/1990 | Gasparrini et al. | 101/425 |
| 5,010,819 | 4/1991 | Uribe et al. | 101/423 |

FOREIGN PATENT DOCUMENTS

| | | | |
|---|---|---|---|
| 1-30449 | 9/1989 | Japan . | |
| 3-266878 | 11/1991 | Japan | 355/303 |

OTHER PUBLICATIONS

Xerox Disclosure Journal, Magnetic Brush Cleaning System, vol. 2, No. 5, Sep./Oct. 1977.

"Newspaper Printing; Printing Edition Revised Version" published by Nippon Shinbun Oct. 31, 1980, p. 61, left column, lines 21 to 34.

*Primary Examiner*—Edgar S. Burr
*Assistant Examiner*—Ren Yan
*Attorney, Agent, or Firm*—Foley & Lardner

[57] ABSTRACT

A drag roller device for a printing apparatus comprises a cleaning means for cleaning a drag roller. The cleaning means is in contact with a part of the circumferential surface of the drag roller except for the circumferential area around which a printed continuous sheet fed from a printing section is wound. The cleaning means may be movable within the circumferential area of the drag roller or separable from it. The cleaning means may be supplied with a cleaning liquid.

In the drag roller device thus constructed, the cleaning means can remove various stains and/or spots of ink transferred from the circumferential surface of the drag roller and/or additional rollers at each revolution of the drag roller. This cleaning operation of the cleaning means ensures to prevent the printed surface of the continuous sheet succeedingly fed from damaging with the stains and spots of ink from the drag roller and so on.

3 Claims, 12 Drawing Sheets

DRAG ROLLER DEVICE FOR PRINTING APPARATUS

BACKGROUND OF THE INVENTION

1. Field of the Invention

The present invention generally relates to a drag roller device adapted for printing apparatuses, and, more particularly relates to a drag roller device equipped with various cleaning mechanisms for cleaning the circumferential surface of the drag roller.

2. Description of the Prior Art

Conventionally, printing apparatuses have employed various drag roller devices to the conveyance of a printed material, for example as shown in "Newspaper Printing; Printing Edition Revised Version" published by Nippon Shinbun Kyokai (Japan Newspaper Association) on Oct. 31, 1980, line 21 to 34 in the left column on page 61, and Japanese Patent for Utility Model Publication No. 1-30449 entitled "Rotary Press Printing Apparatus". In these conventional documents, a typical drag roller device includes a plurality of drag rollers arranged at the downstream side of a printing section. A continuous sheet such as a paper web commonly used as a material to be printed is conveyed among the plurality of drag rollers. The continuous sheet is partially wound around the circumferential surface of the drag roller, or an additional roller forcibly brings the continuous sheet into contact with the circumferential surface of the drag roller to apply the traveling motion to the continuous sheet. Further, the plural drag rollers are driven in such a manner that the circumferential speed of the drag roller is slightly faster than the upstream drag roller so as to feed the continuous sheet to the downstream side with always applying tension thereto.

In a printing process for newspapers, both surfaces of the continuous sheet are printed at the same printing section and fed by the above described drag roller device. The circumferential surface of the drag roller is easily stained by the printed ink on one surface of the continuous sheet which is in contact with the drag roller. Particularly, in the drag roller device including the additional roller which forcibly brings the continuous sheet into the circumferential surface of the drag roller, the circumferential surface of the drag roller is remarkably stained because the printed surface is strongly pressed on the circumferential surface of the drag roller. Further the stained surface of the drag roller will also stain succeeding printed surfaces of the continuous sheet.

The additional roller for bringing the continuous sheet into contact with the drag roller is also stained by the printed surface of the continuous sheet.

BRIEF SUMMARY OF THE INVENTION

It is a primary object of the invention to provide a drag roller device which is free from staining with printed ink.

Another object of the invention is to provide a drag roller device which can keep the circumferential surface of the drag roller clean by a simple means.

To accomplish the above objects, a drag roller device for a printing apparatus comprises a cleaning means for cleaning a drag roller. The cleaning means is in contact with a part of the circumferential surface of the drag roller except for the circumferential area around which a printed continuous sheet fed from a printing section is wound. The cleaning means may be movable within the circumferential area of the drag roller or separable from it. The cleaning means may be supplied with a cleaning liquid.

In the drag roller device thus constructed according to the present invention, the cleaning means can remove various stains or spots of ink from the circumferential surface of the drag roller and/or additional rollers at each revolution of the drag roller. This cleaning operation of the cleaning means prevents the printed surface of the continuous sheet succeedingly fed from the printing section from staining by the drag roller.

Since the drag roller device is so simply constructed, an operator can easily perform maintenance of the device.

Other features and advantages of the invention will be apparent from the following description taken in connection with the accompanying drawing.

DESCRIPTION OF THE PREFERRED EMBODIMENT

The drag roller devices according to the preferred embodiments of the present invention will be described in conjunction with the accompanying drawings. Through the drawings, the same or corresponding components and elements are denoted by the same numerals to facilitate understanding of the present invention.

Figure 1:
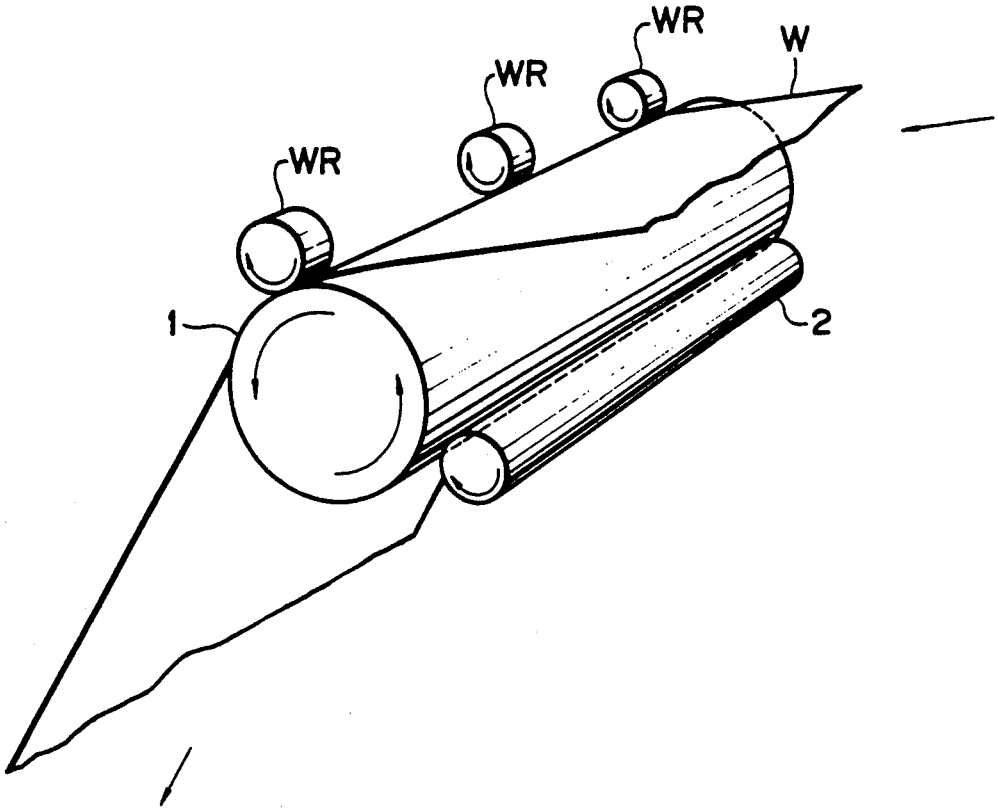
FIG. 1 is a schematic perspective illustration showing the drag roller device according to a first embodiment of the present invention.

Referring to FIG. 1, there is shown a drag roller device according to a first embodiment of the present invention wherein a paper web W, as a continuous sheet to be printed, is wound around a drag roller 1 which is in contact with a contact roller 2 as a cleaning means and a plurality of web rollers WR for retaining the paper web W towards the drag roller 1. In the first embodiment shown in FIG. 1, the contact roller 2 is longer than the width of the paper web W or slightly longer than the whole width defined by the both ends of the web rollers WR. The axis of the contact roller 2 is arranged in parallel to that of the drag roller 1. The contact roller 2 is rotatably supported by well known means. If the contact roller 2 is longer than the width of the paper web W, the contact roller 2 is arranged along the longitudinal direction of the drag roller 1 so as to correspond to a circumferential surface of the drag roller 1 for guiding the paper web W. If the contact roller 2 is slightly longer than the whole width of the web rollers WR, the contact roller 2 is so arranged to cover the whole length of the web rollers WR which retain the paper web W to the drag roller 1. The contact roller 2 is brought into contact with the circumferential surface of the drag roller 1 except for the circumferential area around which the paper web W is wound. Thus the contact roller 2 is revolved in the counter direction of the drag roller 1 by the revolving force of the drag roller 1.

The contact roller 2 is covered with an elastic layer whose circumferential surface is possessed of lipophilic property similar to or more than the circumferential surface of the drag roller 1. Such the elastic material is preferably selected from natural rubber, synthetic rubbers such a nitrile rubber, urethane rubber and the like, and synthetic resins.

Figure 2:
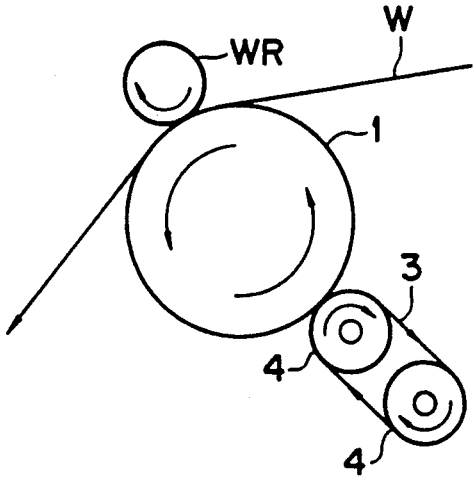
FIG. 2 to FIG. 8 are schematic illustrations showing various configurations of the drag roller device according to second to eighth embodiments of the present invention.
Figure 3:
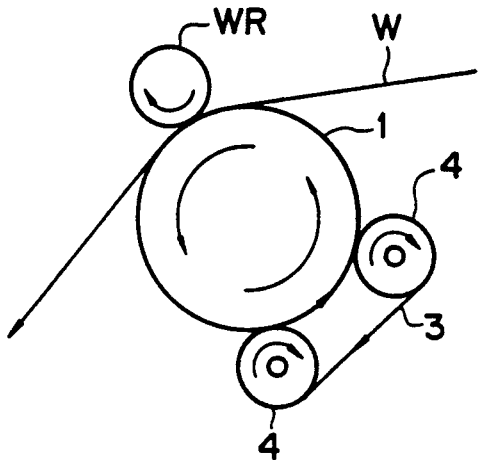

FIG. 2 and FIG. 3 show respectively drag roller devices according to second and third embodiments in which an endless belt 3 as a cleaning means is brought into contact with the circumferential surface of the drag roller 1. This endless belt 3 is also wider than the width of the paper web W or slightly wider than the whole width defined by the both ends of the web roller WR. The endless belt 3 is wound around a pair of support rollers 4 which are rotatably arranged in parallel to the drag roller 1 by well known means. If the endless belt 3 is wider than the width of the paper web W, the endless belt 3 is arranged along the longitudinal direction of the drag roller 1 so as to correspond to the circumferential surface of the drag roller 1 for guiding the paper web W. If the endless belt 3 is slightly wider than the whole width of the web rollers WR, the endless belt 3 is so arranged to cover the whole length of the web rollers WR which retain the paper web W to the drag roller 1. At least one of the support rollers 4 brings the endless belt 3 into contact with the circumferential surface of the drag roller 1 except for the circumferential area around which the paper web W is wound. Thus the endless belt 3 is moved in the counter direction of the drag roller 1 by the revolving force of the drag roller 1.

Each of the endless belt 3 and/or the support rollers 4 is provided with an elastic layer, and the surface of the endless belt 3 is made of the same material as the circumferential surface of the drag roller 1.

Figure 4:
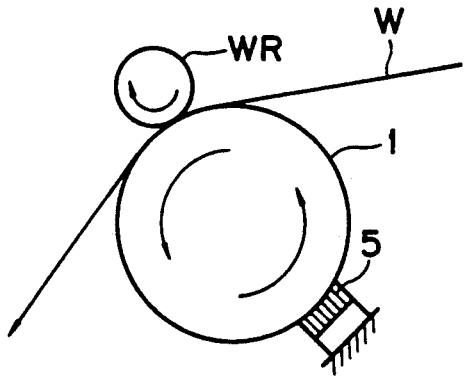

FIG. 4 shows a drag roller device according to a fourth embodiment in which a stick type brush 5 is used as a cleaning means. The stick type brush 5 is longer than the width of the paper web W or slightly longer than the whole width defined by the both ends of the web rollers WR. The axis of the stick type brush 5 is arranged in parallel to that of the drag roller 1 by any suitable means. If the stick type brush 5 is longer than the width of the paper web W, the stick type brush 5 is arranged along the longitudinal direction of the drag roller 1 so as to correspond to circumferential surface of the drag roller 1 for guiding the paper web W. If the stick type brush 5 is slightly longer than the whole width of the web rollers WR, the stick type brush 5 is so arranged to cover the whole length of the web rollers WR which retain the paper web W to the drag roller 1. The brush end of the stick type brush 5 is brought into contact with the circumferential surface of the drag roller 1 except for the circumferential area around which the paper web W is wound.

The bristles of the brush 5 can be selected from any elastic members capable of brushing the circumferential surface of the drag roller 1.

Figure 5:
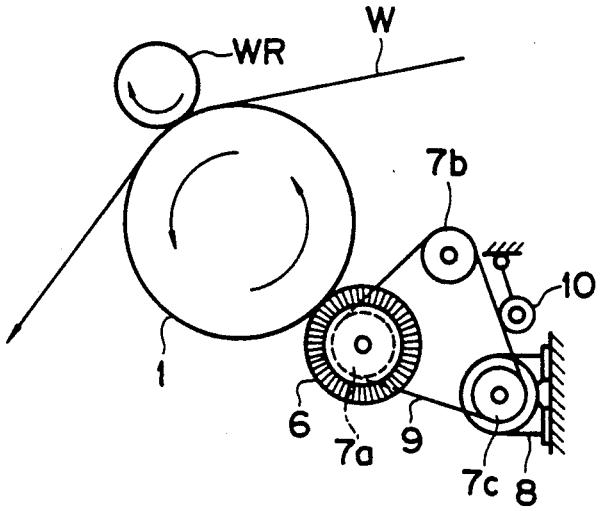

FIG. 5 shows a drag roller device according to a fifth embodiment in which a rotating brush 6 is used as a cleaning means. The bristle end of the brush 6 is in contact with the circumferential surface of the drag roller 1. The rotating brush 6 is provided with a shaft end pulley 7*a*. A drive belt 9 is wound around the shaft end pulley 7*a*, an intermediate pulley 7*b* and an output pulley 7*c* of a power motor 8. The drive belt 9 is applied with tension by a tension pulley 10. According to this construction, the rotating brush 6 can be rotated independent of the drag roller 1 in the counter direction or the same direction as it by the revolving force of the power motor 8.

The bristles of the rotating brush 6 can be selected from any elastic members capable of brushing the circumferential surface of the drag roller 1.

Figure 6:
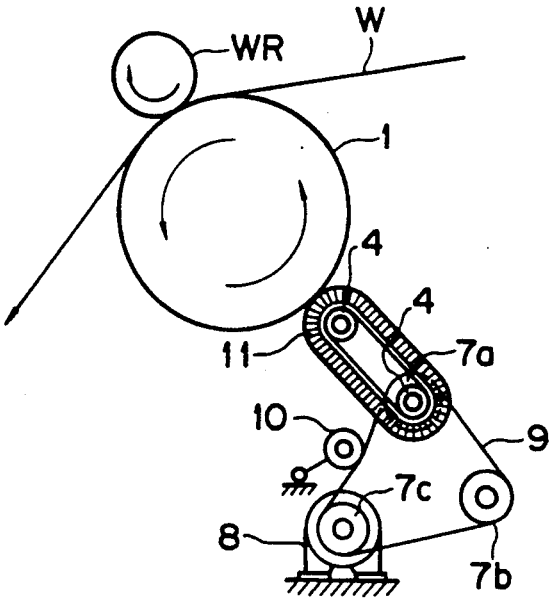
Figure 7:
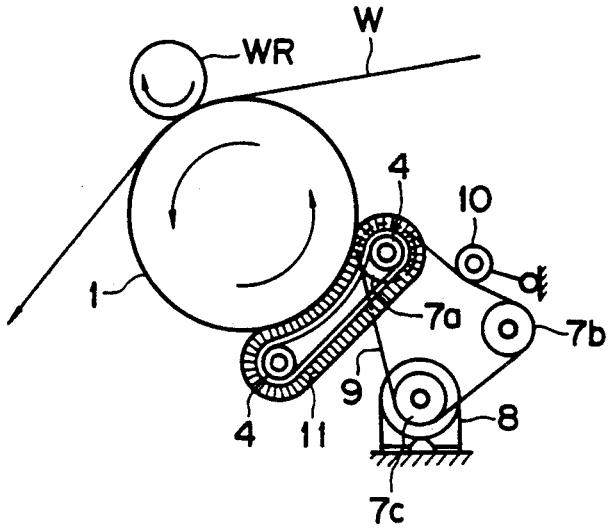

FIG. 6 and FIG. 7 show drag roller devices according to sixth and seventh embodiments which are modifications of the drag roller devices shown in FIG. 2 and FIG. 3, respectively. That is, the drag roller devices shown in FIG. 6 and FIG. 7 employ an endless brush belt 11 as a cleaning means instead of the endless belt 3 shown in FIG. 2 and FIG. 3. One of the support rollers 4 is provided with a shaft end pulley 7*a*. A drive belt 9 is wound around the shaft end pulley 7*a*, an intermediate pulley 7*b* and an output pulley 7*c* of a power motor 8. The drive belt 9 is applied with tension by a tension pulley 10. According to this construction, the support roller 4 can be rotated independent of the drag roller 1 in the counter direction or the same direction as it by the revolving force of the power motor 8. The endless brush belt 11 is also moved in the counter direction or the same direction of the drag roller 1. The brush end of the endless brush belt 11 is moved along the circumference of the drag roller 1 with keeping in contact with the circumferential surface of the drag roller 1 by the retaining force of at least one of the support rollers 4.

The bristles of the endless brush belt 11 can be selected from any elastic members capable of brushing the circumferential surface of the drag roller 1.

Figure 8:
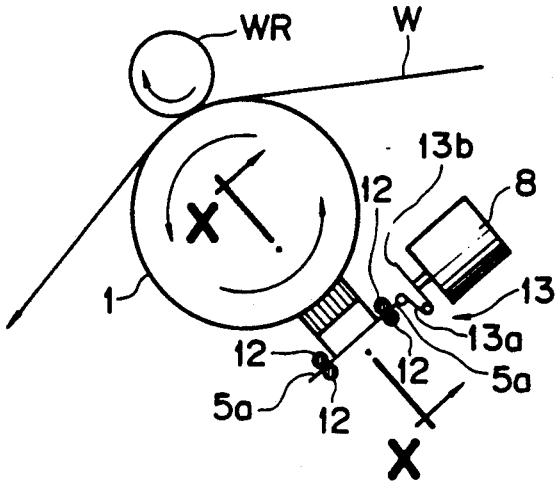
Figure 9:
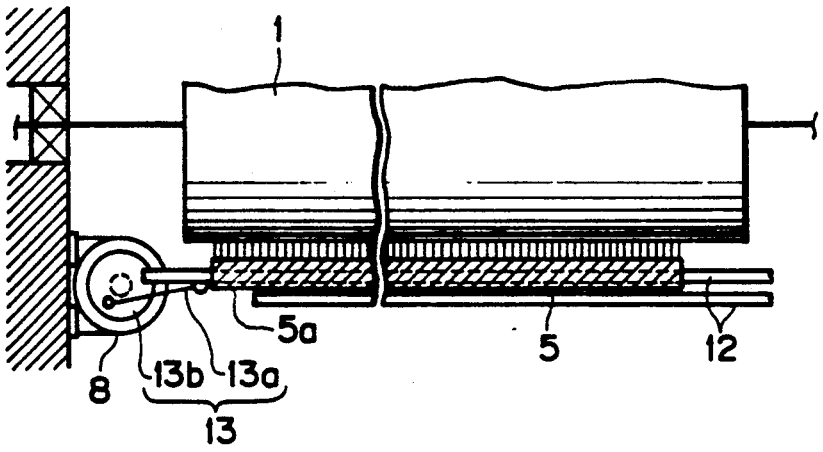
FIG. 9 is a schematic elevational view taken in the direction of the arrows X—X of FIG. 8.

FIG. 8 and FIG. 9 show a drag roller device according to an eighth embodiment which is a modification of the drag roller device shown in FIG. 4. That is, the drag roller device shown in FIG. 8 and FIG. 9 employs a driving means for driving the stick type brush 5 in its longitudinal direction.

At both sides of the stick of the stick type brush 5, flanges 5*a*, 5*a* extending in the longitudinal direction of the brush 5 are integrally formed. Each of the flanges 5*a*, 5*a* is supported by a pair of guide bars 12, 12 which are extendingly arranged in parallel to the flange 5*a* so that the stick type brush 5 can be reciprocally moved in the longitudinal direction of the drag roller 1 by the driving means. This driving means comprises a crank mechanism 13 and a power motor 8. The crank mechanism 13 includes a linkage bar 13*a* whose base end is pivotally and eccentrically secured to a drive plate 13*b* fixed to an output shaft of the power motor 8, and whose top end is pivotally secured to the end of the frange 5*a* at the one side of the stick type brush 5.

Figure 10:
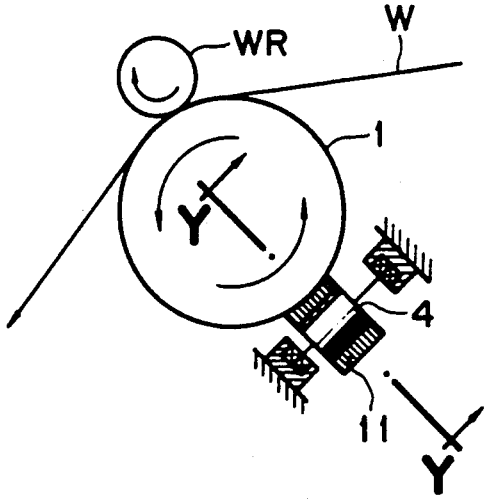
FIG. 10 is a schematic illustration showing one configuration of the drag roller device according to a ninth embodiment of the present invention.
Figure 11:
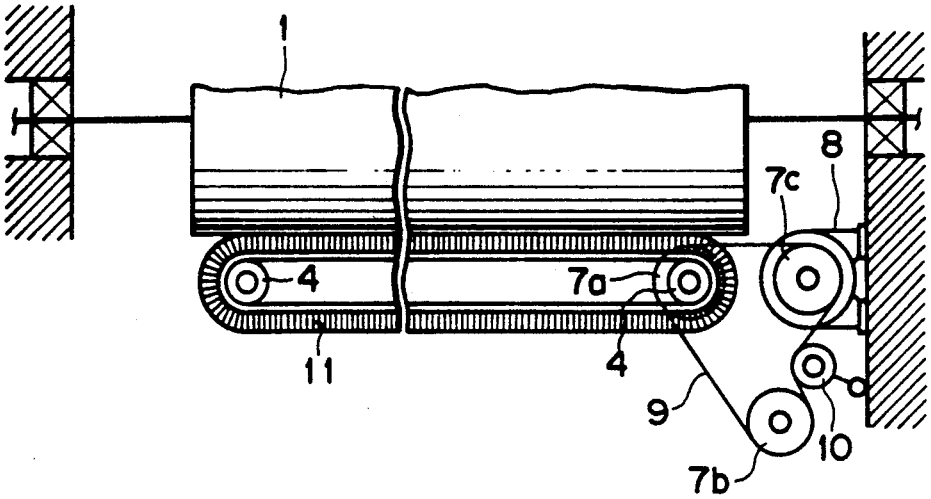
FIG. 11 is a schematic elevational view taken in the direction of the arrows Y—Y of FIG. 10.

FIG. 10 and FIG. 11 show a drag roller device according to an ninth embodiment which is a modification of the drag roller device shown in FIG. 7. That is, the drag roller device shown in FIG. 10 and FIG. 11 employs an endless brush belt 11 extendingly arranged in the longitudinal direction of the drag roller 1.

In the ninth embodiment, the width of the endless brush belt 11 is not so wide as that shown in FIG. 6 and FIG. 7. On the other hand, the length between the support rollers 4, 4 must be longer than the width of the paper web W or slightly longer than the whole width defined by the both ends of the web rollers WR. The bristles of the endless brush belt 11 are always in contact with the circumferential surface of the drag roller 1 at the support rollers 4, 4 and along therebetween, and the endless brush belt 11 is moved in the longitudinal direction of the drag roller 1.

In the embodiments shown in FIG. 5, FIG. 6, FIG. 7, FIG. 10 and FIG. 11, the driving combination between the drive belt 9 and the pulleys *7a*, *7b*, *7c* may be replaced with a timing belt and tooth formed pulleys; or a chain and sprocket wheels. Further, the tension pulley 10 may be also replaced with any suitable member adapted for each mechanism.

Drag roller devices according to tenth, eleventh, twelfth, thirteenth, fourteenth and fifteenth embodiments shown in FIG. 12 to FIG. 18 are modifications of the embodiments shown in FIG. 1, FIG. 2, FIG. 4, FIG. 5, FIG. 6, FIG. 10 and FIG. 11, respectively. In these modified embodiments, the contact roller 2, the endless belt 3, the stick type brush 5, the rotating brush 6 and the endless brush belt 11 are movably arranged by drive mechanisms between their contact position and their separate position with respect to the circumferential surface of the drag roller 1. The drive mechanism may be selected from a pneumatic or hydraulic cylinder, an electromagnetic actuating device, a screw driving device and the like.

These modified embodiments provide an advantage that cleaning means such as the contact roller, the endless belt, the rotating brush and the endless brush belt can be easily separated from the drag roller 1 when the printing work is not carried out to set the paper web, set or replace a printing plate at the printing section, clean the printing apparatus after printing work, and so on. Therefore, the cleaning means can be free from damaging, or deforming in comparison with the non-separable type cleaning means shown in FIG. 1 to FIG. 11. This will also extend the period capable of using the cleaning means, thereby reducing running cost of the printing apparatus.

Figure 12:
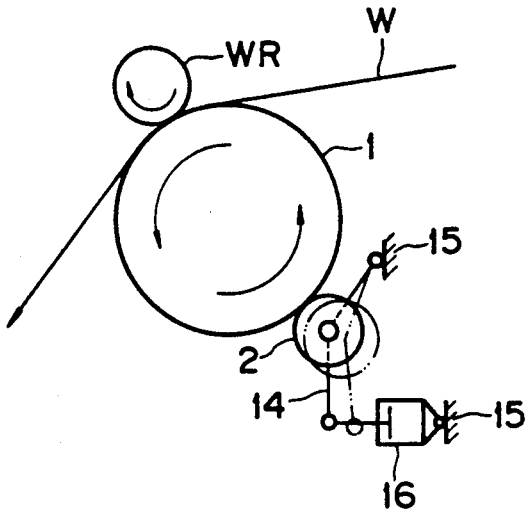
FIG. 12 to FIG. 17 are schematic illustrations showing various configurations of the drag roller device according to tenth to fifteenth embodiments of the present invention.

In the tenth embodiment shown in FIG. 12, both ends of the axis of the contact roller 2 shown in FIG. 1 are rotatably supported by center position of swing arms 14, 14. Base ends of the swing arms 14, 14 are pivotably connected to a stationary member 15 and the other ends are connected each other through a link arm, not shown in the drawing. One of the swing arms 14, 14 is connected to a piston rod of a hydraulic cylinder 16. The hydraulic cylinder 16 is also pivotably connected to the stationary member 15.

Figure 13:
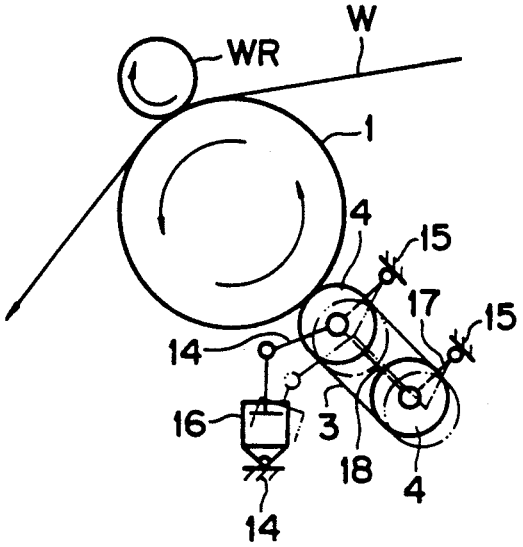

In the eleventh embodiment shown in FIG. 13, both ends of the axis of one of the support rollers 4 shown in FIG. 2 are rotatably supported by center position of swing arms 14, 14, and both ends of the axis of the other support roller 4 are rotatably supported by free end of another swing arm 17, 17. Base ends Of the swing arms 14, 14, and 17, 17 are pivotably connected to a stationary member 15. The same side axis ends of the support rollers 14 and 17 are connected each other through a connection rod 18 to form a parallel link mechanism. The other ends of the swing arms 14, 14 are connected each other through a link arm, not shown in the drawing. At least one of the swing arms 14, 14 is connected to a piston rod of a hydraulic cylinder 16 through the link arm. The hydraulic cylinder 16 is also pivotably connected to the stationary member 15.

Figure 14:
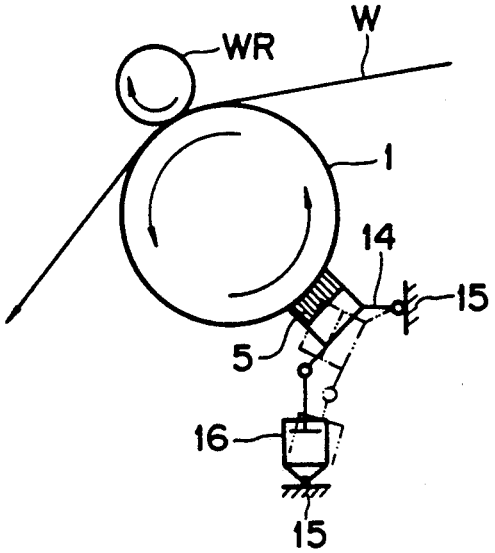

In the twelfth embodiment shown in FIG. 14, both ends of the axis of the stick type brush 5 shown in FIG. 4 are supported by center position of swing arms 14, 14. Base ends of the swing arms 14, 14 are pivotably connected to a stationary member 15 and the other ends are connected each other through a link arm, not shown in the drawing. One of the swing arms 14, 14 is connected to a piston rod of a hydraulic cylinder 16. The hydromatic cylinder 16 is also pivotably connected to the stationary member 15.

Figure 15:
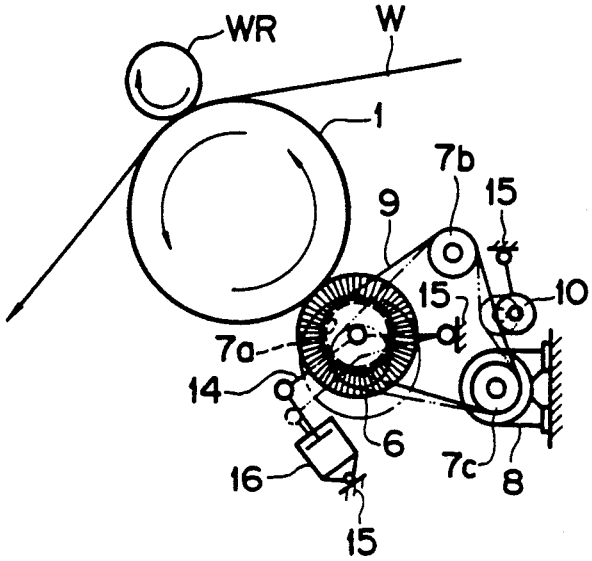

In the thirteenth embodiment shown in FIG. 15, both ends of the axis of the rotating brush 6 shown in FIG. 5 are rotatably supported by center positioning swing arms 14, 14. Base ends of the swing arms 14, 14 are pivotably connected to a stationary member 15 and the other ends are connected each other through a link arm, not shown in the drawing. One of the swing arms 14, 14 is connected to a piston rod of a hydraulic cylinder 16. The hydromatic cylinder 16 is also pivotably connected to the stationary member 15.

Figure 16:
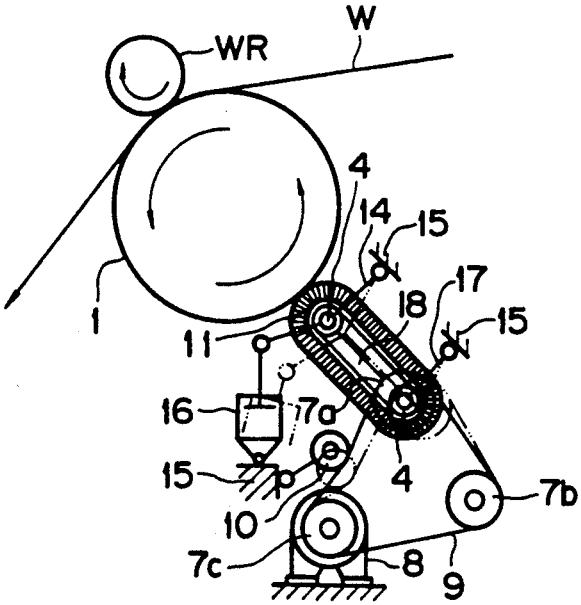

In the fourteenth embodiment shown in FIG. 16, both ends of the axis of one of the support rollers 4 shown in FIG. 6 are rotatably supported by center positioning of swing arms 14, 14, and both ends of the axis of the other support roller 4 are rotatably supported by free ends of another swing arms 17, 17. Base ends of the swing arms 14, 14, ad 17, 17 are pivotably connected to a stationary member 15. The same side of the axial ends of the swing arm 14 and 17 are connected to each other through a connection rod 18 to form a parallel link mechanism. The other ends of the swing arms 14, 14 are connected to each other through a link arm, not shown in the drawing. At least one of the swing arms 14, 14 is connected to a piston rod of a hydraulic cylinder 16 through the link arm. The hydraulic cylinder 16 is also pivotably connected to the stationary member 15.

Figure 17:
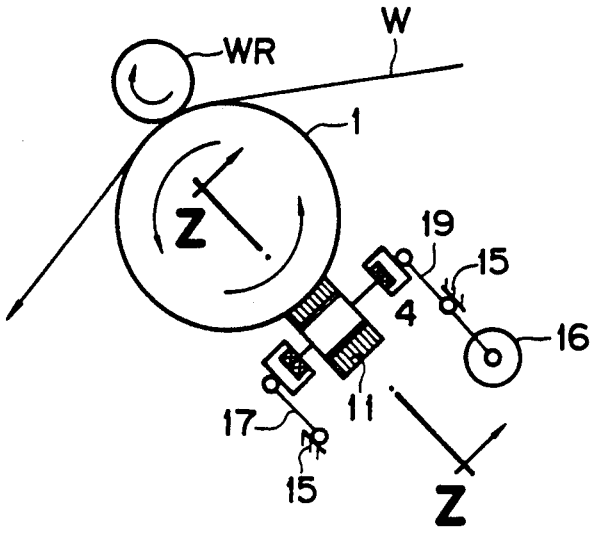
Figure 18:
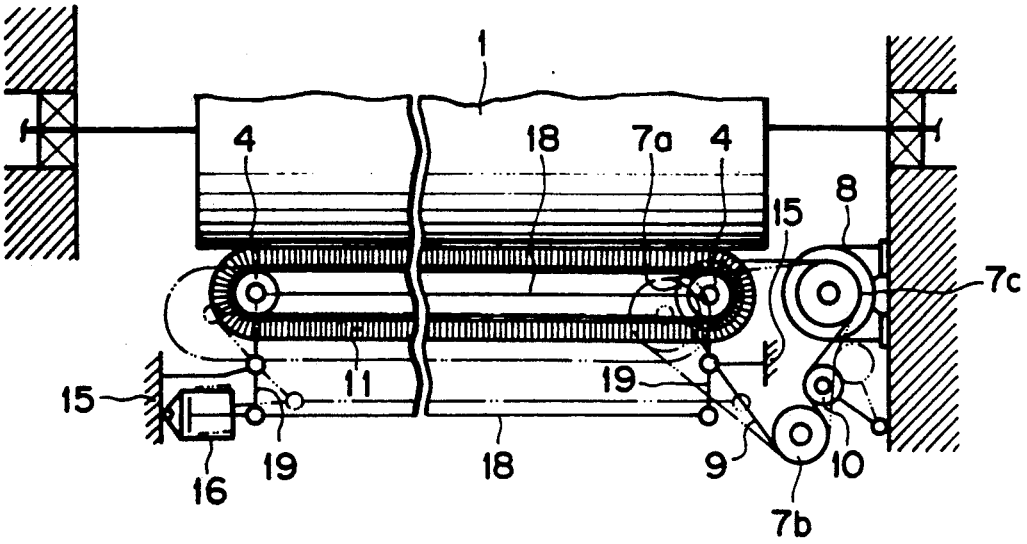
FIG. 18 is a schematic elevational view taken in the direction of the arrows C—C of FIG. 17.

In the fifteenth embodiment shown in FIG. 17 and FIG. 18, the same side axis ends of the support rollers 4 shown in FIG. 10 and FIG. 11 are rotatably supported by free ends of swing arms 17, 17, and the other side axis ends are rotatably supported by free ends of swing arms 19, 19, respectively. Base ends of the swing arms 17, 17, and center positions of the swing arms 19, 19 are pivotably connected to stationary members 15. Base ends of the swing arms 19, 19 are the same side axis ends of the support rollers 4 are connected to both ends of connection rods 18, 18, 18 to form a parallel link mechanism At least one of the ,swing arms 19, 19 is connected to a piston rod of a hydraulic cylinder 16 through the link arm. The hydraulic cylinder 16 is also pivotably connected to the stationary member 15.

In the same manner as the above modifications, the endless belt 3, the endless brush belt 11 and the stick type brush 5 in the embodiments shown in FIG. 3, FIG. 7 and FIG. 8 may be also movably arranged by well known drive mechanisms. These modified configurations are not shown in the drawings.

The contact members such as the contact roller 2, in the above described embodiments, may be also varied, for example its circumferential surface member brought into contact with the drag roller 1 may be made of a cloth material such as canvas, non-woven fabric, and the like, or a porous material such as foamed resin, felt, and the like, or composite material thereof. When these various contact members are used in the configurations shown in FIG. 1, FIG. 2 and FIG. 3, the contact roller 2 or the endless belt 3 is preferably provided with any control means (not shown in the drawings) for controlling the revolution of them.

Further, if such the cloth or porous contact member can contain cleaning liquid for cleaning the circumferential surface of the drag roller 1, the contact member is previously loaded with the cleaning liquid or supplied with the cleaning liquid from a cleaning liquid supplying means. Alternatively, the cleaning liquid may be directly supplied to the drag roller 1.

Figure 19:
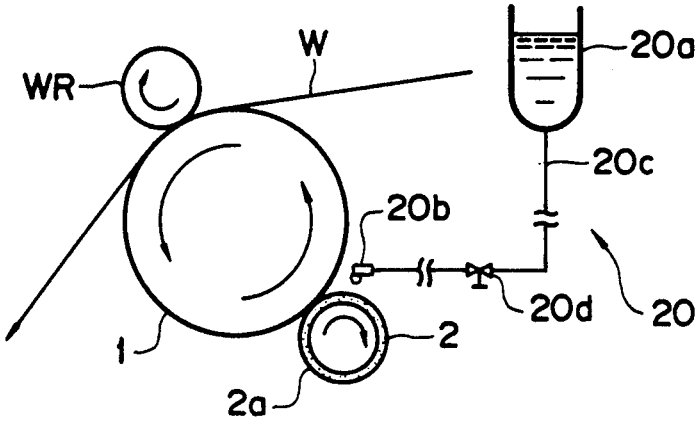
FIG. 19 to FIG. 22 are schematic illustrations showing various configurations of the drag roller device according to sixteenth to nineteenth embodiments of the present invention.

A sixteenth embodiment shown in FIG. 19 employs a contact roller 2 whose circumferential surface is covered with a cloth layer 2*a*, and a cleaning liquid supplying means 20 for supplying the cleaning liquid to the cloth layer 2*a*. This cleaning liquid supplying means 20 comprises a cleaning liquid reservoir 20*a*, a nozzle member 20*b* extending along the whole length of the contact roller 2, and a pipe system 20*c* connected between the cleaning liquid reservoir 20*a* and the nozzle member 20*b*. The pipe system 20*c* is further provided with a control valve 20*d*. The contact roller 2 is also provided with a control means ((not shown in the drawing) to control the revolving speed of the contact roller 2.

Figure 20:
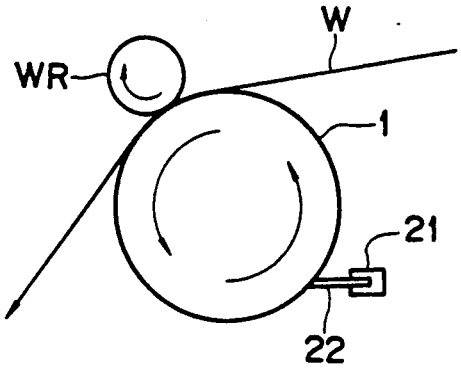

A seventeenth embodiment shown in FIG. 20 employs a felt member 22 held by a holder 21 instead of the stick type brush 5 shown in the FIG. 4. The felt member 22 contains the cleaning liquid.

Of course the drag roller devices shown in FIG. 19 and FIG. 20 do not always need the cleaning liquid.

Operations on thus constructed drag roller devices will be described in detail.

In a commonly used rotary press printing system, the drag roller devices are arranged at the downstream side of a printing section. At each of the drag roller devices, the paper web W fed from the printing section is wound around the circumferential surface of the drag roller 1 at a predetermined angle. Alternatively, in addition to winding the paper web W around the drag roller 1, the paper web W 1 is forcibly depressed on the circumferential surface of the drag roller 1 by the web roller WR. The drag rollers 1 are so controlled as to drive the downstream drag roller slightly faster than adjacent upstream drag roller, thereby feeding the paper web to the downstream side while always applying tension to it. Upon running the paper web, the printed ink on the paper web W is partially transferred to the circumferential surface of the drag roller 1. This transferred ink can be completely removed from the circumferential surface of the drag roller 1 at every revolution of the drag roller 1 by the cleaning means having various configurations already described.

In the first embodiment shown in FIG. 1, when the drag roller 1 is revolved in the arrow direction, the contact roller 2 is also revolved in the counter direction of the drag roller 1 by the revolving force of the drag roller 1. Since the circumferential surface of the contact roller 2 is firmly in contact with that of the drag roller 1, the ink and stains are peeled off and removed from the circumferential surface of the drag roller 1. The removed ink and stains adhere to the surface of the contact roller 2 and are thereon to prevent the ink and stains from re-transferring to the circumferential surface of the drag roller 1.

In the second and third embodiments shown in FIG. 2 and FIG. 3, when the drag roller 1 is revolved in the arrow direction, the endless belt 3 brought into contact with the circumferential surface of the drag roller 1 by at least one of the support rollers 4, 4 is revolved in the counter direction of the drag roller 1 by the revolving force of the drag roller 1. Accordingly, the ink and stains are peeled off and removed from circumferential surface of the drag roller 1 by the endless belt 3. The removed ink and stains adhere to the surface of the endless belt 3.

In the fourth embodiment shown in FIG. 4, as the drag roller 1 is revolved, the ink and stains are brushingly removed from the circumferential surface of the drag roller 1 by the bristles of the stick type brush 5 which is arranged in parallel to the longitudinal axis of the drag roller 1 so as to be in contact with the circumferential surface of the drag roller 1.

In the fifth embodiment shown in FIG. 5, the rotating brush 6 is revolved in the same or counter direction of the drag roller 1 by the revolving force of the power motor 8 through the belt-drive mechanism (7*a*, 7*b*, 7*c*, and 9). Accordingly, the ink and stains are brushingly removed from the circumferential surface of the drag roller 1 by the bristles of the rotating brush 6. When the rotating brush 6 is revolved in the counter direction of the drag roller 1, their circumferential revolving speeds must be different each other.

In the sixth and seventh embodiments shown in FIG. 6 and FIG. 7, the endless brush belt 11 is revolved in the same or counter direction of the drag roller 1 by the revolving force of the power motor 8 through the belt-drive mechanism (7*a*, 7*b*, 7*c*, and 9) and the support rollers 4, 4. In the ninth embodiment shown in FIG. 10 and FIG. 11, the endless brush belt 11 is reciprocatingly moved between the support rollers 4, 4 in parallel to the longitudinal axis of the drag roller 1 by the revolving force of the power motor 8 through the belt-drive mechanism (7*a*, 7*b*, 7*c* and 9) and the support rollers 4, 4. Accordingly, the ink and stains are brushingly removed from the circumferential surface of the drag roller 1 by the bristles of the endless brush belt 11. When the endless brush belt 11 is revolved in the counter direction of the drag roller 1, their circumferential revolving speeds must be different from each other.

In the eighth embodiment shown in FIG. 8 and FIG. 9, the stick type brush 5 is reciprocatingly moved along the guide bars 12, 12 in parallel to the longitudinal axis of the drag roller 1 by the revolving force of the power motor 8 through the crank mechanism 13. Accordingly, the ink and stains are brushingly removed from the circumferential surface of the drag roller 1 by the bristles of the stick type brush 5.

In the tenth, twelfth, and thirteenth embodiments shown in FIG. 12, FIG. 14 and FIG. 15, the swing arms 14, 14 are moved in the clockwise direction shown in the drawings when the piston rod is extended upon the actuation of the hydraulic cylinder 16. The circumferential surface of the contact roller 2, the bristles of the stick type brush 5 and the rotating brush 6 are brought into contact with the circumferential surface of the drag roller 1. Accordingly, the ink and stains are peeled off or brushingly removed from the circumferential surface of the drag roller 1 by the contact roller 2 or the bristles of the stick type brush 5 or the rotating brush 6 in the same manner as the first, fourth and fifth embodiments shown in FIG. 1, FIG. 4 and FIG. 5. Alternatively, the swing arms 14, 14 are moved in the counter-clockwise direction shown in the drawings when the piston rod is withdrawn upon the counter actuation of the hydromatic cylinder 16. The circumferential surface of the contact roller 2, the bristles of the stick type brush 5 and the rotating brush 6 are parted from the circumferential surface of the drag roller 1. The contact roller 2, the stick type brush 5 and the rotating brush 6 are returned to their waiting position.

In the eleventh embodiment shown in FIG. 13 and the fourteenth embodiment shown in FIG. 16, the swing arms 14, 14 are moved in the clockwise direction shown in the drawings when the piston rod is extended upon the actuation of the hydraulic cylinder 16. The circumferential surface of the endless belt 3 and the bristles of the endless brush belt 11 are brought into contact with the circumferential surface of the drag roller 1 through the parallel link mechanism constituted by the swing arms 14, 14 and 17, 17, and the connection rods 18, 18. Accordingly, the ink and stains are peeled off or brushingly removed from the circumferential surface of the drag roller 1 in the same manner as the second and sixth embodiments shown in FIG. 2 and FIG. 6. Alternatively, the swing arms 14, 14 are moved in the counter-clockwise direction shown in the drawings when the piston rod is withdrawn upon the counter actuation of the hydraulic cylinder 16. The circumferential surface of the endless belt 3 and the bristles of the endless brush belt 11 are parted from the circumferential surface of the drag roller 1 through the parallel link mechanism constituted by the swing arms 14, 14 and 17, 17, and the connection rods 18, 18. The endless belt 3 and the endless brush belt 11 are returned to their waiting position.

In the fifteenth embodiment shown in FIG. 17 and FIG. 18, the swing arms 19, 19 are moved in the clockwise direction shown in the drawings when the piston rod is withdrawn upon the actuation of the hydraulic cylinder 16. The bristles of the endless, brush belt 11 are brought into contact with the circumferential surface of the drag roller 1 through the parallel link mechanism constituted by the swing arms 19, 19 and 17, 17, and the connection rods 18, 18, 18. Accordingly, the ink and stains are brushingly removed from the circumferential surface of the drag roller 1 in the same manner as the ninth embodiment as shown in FIG. 10 and FIG. 11. Alternatively, the swing arms 19, 19 drawings when the piston rod is extended upon the counter actuation of the hydraulic cylinder 16. The bristles of the endless brush belt 11 are parted from the circumferential surface of the drag roller 1 through the parallel link mechanism constituted by the swing arms 19, 19 and 17, 17, and the connection rods 18, 18, 18. The endless brush belt 11 are returned to their waiting position.

In the sixteenth embodiment shown in FIG. 19, when the drag roller 1 is revolved in the arrow direction, the contact roller 2 is also revolved in the counter direction of the drag roller 1 at a slightly slower speed than that of the drag roller, 1 by a speed control means. At the same time, the cleaning liquid reserved in the reservoir 20*a* is supplied to the cloth layer 2*a* and/or the circumferential surface of the drag roller 1 through the nozzle member 20*b* of the cleaning liquid supplying means 20. The cloth layer 2*a* of the contact roller 2 contains the cleaning liquid which extricates the ink and stains from the circumferential surface of the drag roller 1. Then the cloth layer 2*a* of the contact roller 2 can easily and completely remove the ink and stains from the drag roller 1.

The control valve of the cleaning liquid supplying means 20 controls the flow rate of the cleaning liquid supplied from the nozzle member 20*b* through the pipe system 20*c*, or stops the supply.

Even when the cleaning liquid is not supplied to the contact roller 2, the cloth layer 2*a* of the contact roller 2 can remove the ink and stains from the circumferential surface of the drag roller 1.

In the seventeenth embodiment shown in FIG. 20, the felt member 22 is arranged in essentially parallel to the longitudinal axis of the drag roller 1 so as to be in contact with the circumferential surface of the drag roller 1. The felt member 22 contains the cleaning liquid which can extricate the ink and stains from the circumferential surface of the drag roller 1 and remove them easily.

Even when the felt member 22 does not contain the cleaning liquid, the felt member 22 can remove the ink and stains from the circumferential surface of the drag roller 1.

In the above described embodiments shown in FIG. 1 to, FIG. 20, the contact length of the cleaning means drag roller 1 in the longitudinal direction of the drag roller 1 is longer than the width of the paper web W, or slightly longer than the whole length between the web rollers WR for retaining the paper web W onto the circumferential surface of the drag roller 1. These lengths may be varied in response to the length between frames for supporting the drag roller 1.

The contact member of the cleaning means may be divided and the divided contact members may be arranged in parallel to the axis of the drag roller 1. Each of the divided contact members may be moved within each cleaning area corresponding to divided section of the circumferential surface of the drag roller 1.

Figure 21:
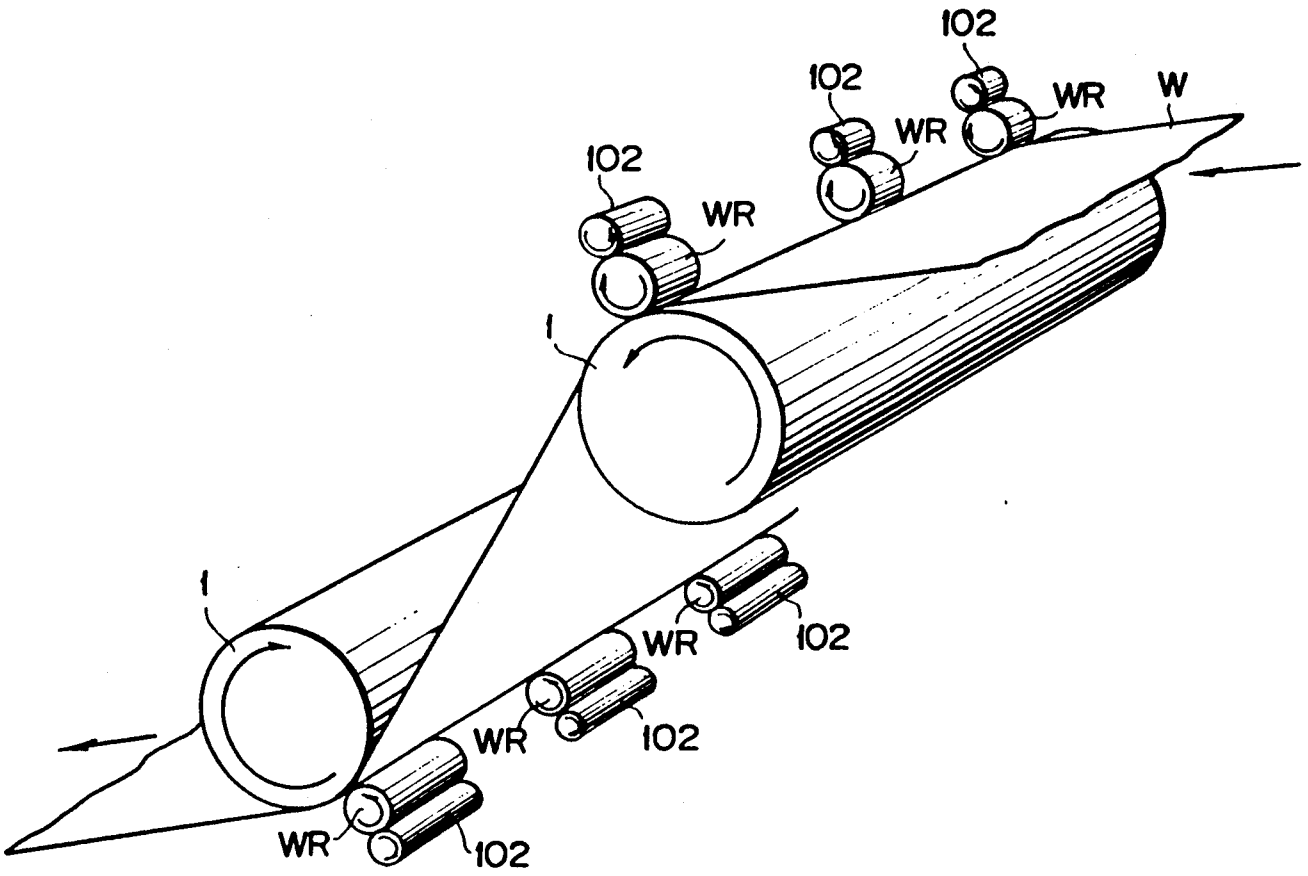

FIG. 21 shows a drag roller device according to an eighteenth embodiment in which each of the web rollers WR is provided with a contact roller 102. The contact roller 102 is slightly longer than that of the web roller WR and arranged in parallel to the web roller WR so as to coordinate the contact rollers 102 with the corresponding web rollers WR to retain completely the paper web W onto the circumferential surface of the drag roller 1. The contact rollers 102 are rotatably supported by commonly used support means. Further the contact rollers 102 are also brought into contact with the circumferential surface of the web rollers WR so that the contact rollers 102 are revolved in the counter direction of the web rollers WR.

Each of the contact rollers 102 is covered with an elastic layer whose circumferential surface, .is possessed of lipophilic property similar to or more than the circumferential surface, of the web roller WR. Such elastic material is preferably selected from natural rubber, synthetic rubbers such as nitrile rubber, urethane rubber and the like, and synthetic resins.

The contact rollers 102 may be also replaced by the various configured cleaning means shown in FIG. 2 to FIG. 20.

A typical operation of the eighteenth embodiment shown in FIG. 21 will be described.

In a commonly used rotary press printing system, the drag roller devices are arranged at the downstream side of a printing section. At each of the drag roller devices, the paper web W fed from the printing section is wound around the circumferential surface of the drag roller 1 at a predetermined angle. Then, in addition to winding the paper web W around the drag roller 1, the paper web W 1 is forcibly depressed on the circumferential surface of the drag roller 1 by the web rollers WR. Upon running the paper web W, the printed ink on the paper web W is partially transferred to the circumferential surface of the drag roller 1. This transferred ink can be completely removed from the circumferential surface of the drag roller 1 at every revolution of the drag roller 1 by the contact members such as the contact rollers 102 which are in contact with the circumferential surface of the web rollers WR or the combination of the contact members and the cleaning liquid.

In the eighteenth embodiment shown in FIG. 21, the web roller WR is revolved in the counter direction of the web roller WR by the revolving force of the web roller WR. The ink and stains are peeled off and removed from the circumferential surface of the web roller WR. The removed ink and stains adhere to the surface of the contact roller 102 and are piled thereon.

When the contact roller 102 is replaced by the cleaning means shown in FIG. 2 to FIG. 20, the ink and stains are removed from the circumferential surface of the web rollers WR as in the drag roller 1.

Figure 22:
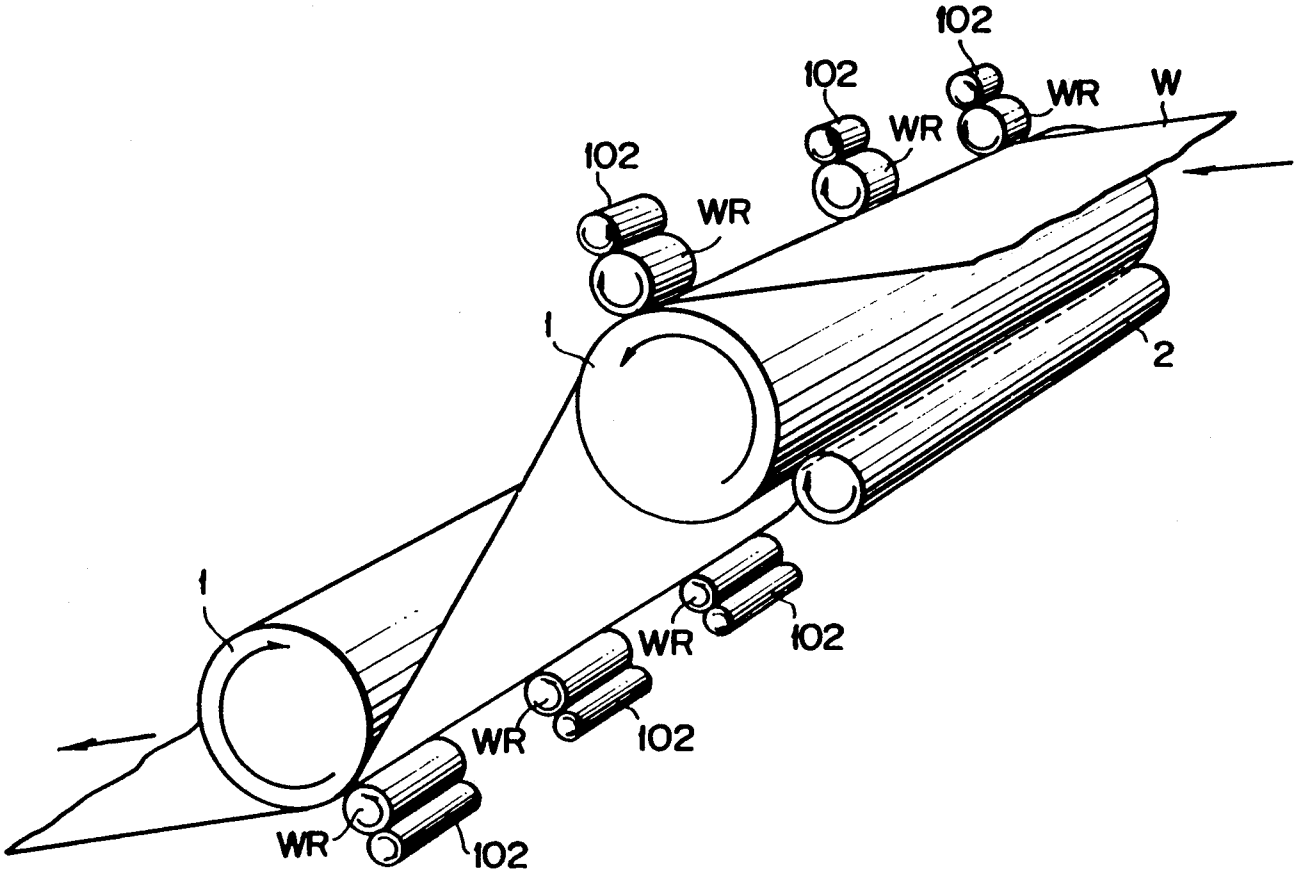

FIG. 22 shows a drag roller device according to a nineteenth embodiment in which each of the web rollers WR and the drag roller 1 are respectively provided with a short contact roller 102 and a long contact roller 2. The short and long contact rollers 102 and 2 may be also replaced by the various configured cleaning means shown in FIG. 2 to FIG. 20. The ink and stains are simultaneously removed from each circumferential surface of the web rollers WR and the drag roller 1 by their cleaning functions of the respective cleaning means.

As explained above, the drag roller device according to the present invention includes a simple constructed cleaning means which can remove various stains or spots of ink from the circumferential surface of the drag roller and/or the additional rollers at each revolution of the drag roller and/or additional rollers. This cleaning operation of this cleaning means prevents the succeedingly fed printed surface of the paper web from being damaged with such stains or ink spots re-transferred from the drag roller and/or the additional rollers. The drag roller device according to the invention is so simple that its maintenance is extremely easy and thus the operator is free from complicated work.

As many apparently widely different embodiments of this invention may be made without departing from the spirit and scope thereof, it is to be understood that the invention is not limited to the specific embodiments thereof except as defined in the appended claims.

What is claimed is:

1. An apparatus for printing a continuous sheet, comprising:

(A) a roller having a circumferential surface;

(B) drive means for driving said continuous sheet through said apparatus; and (C) a cleaning device which selectively cleans a part of said circumferential surface of said roller, said cleaning device including (i) a rotary element which is driven by said drive means, (ii) a stationary member, (iii) a swing arm having a first end cooperating with said rotary element and a second end pivotally connected to said stationary member, and (iv) a hydraulic cylinder which has a first end connected to said swing arm and a second end connected to said stationary member, said hydraulic cylinder selectively pivoting said swing arm and said rotary element form a first position in which said cleaning device contacts said circumferential surface of said roller to a second position in which said cleaning device is isolated from said circumferential surface of said roller;

wherein said cleaning device further comprises:

a link arm which extends axially through said rotary element and which has first and second ends, said first end being pivotally connected to said first end of said swing arm, and a second swing arm having a first end which is pivotally connected to said second end of said link arm and a second end which is pivotally connected to said stationary member;

wherein said rotary element comprises a support roller, and further comprising an endless brush belt which is rotatably supported by said support roller and which contacts said circumferential surface of said roller when said cleaning device is in said first position; and wherein said cleaning device further comprises:

a second support roller which is spaced from said support roller and which rotatably supports said endless brush belt, a second link arm extending axially through said second support roller, and third and fourth swing arms, each of which has a first end connected to a respective end of said second link arm and a second end which is pivotally connected to said stationary member.

2. An apparatus according to claim 1, wherein said cleaning device further comprises first and second connection rods connecting said first and third swing arms and said second and fourth swing arms, respectively.

3. An apparatus for cleaning a circumferential surface of a roller of a printing apparatus, comprising:

(A) a first, driven support roller;

(B) a second support roller which is spaced from said first support roller;

(C) an endless brush belt which is rotatably supported on said first and second support rollers;

(D) a support member;

(E) a parallelogram linkage pivotally connecting said first and second support rollers to said support member; and (F) a hydraulic cylinder which has a first end connected to said parallelogram linkage and a second end connected to said support member, said hydraulic cylinder selectively pivoting said parallelogram linkage and said first and second support rollers from a first position in which said endless brush belt contacts said circumferential surface of said roller to a second position in which said endless brush belt is isolated from said circumferential surface of said roller.

* * * * *